US009096995B1

(12) United States Patent
Al-Qaneei

(10) Patent No.: US 9,096,995 B1
(45) Date of Patent: Aug. 4, 2015

(54) WATER/SOAP DISPENSER

(71) Applicant: Jassem M. Al-Jasem Al-Qaneei, Salam (KW)

(72) Inventor: Jassem M. Al-Jasem Al-Qaneei, Salam (KW)

( * ) Notice: Subject to any disclaimer, the term of this patent is extended or adjusted under 35 U.S.C. 154(b) by 0 days.

(21) Appl. No.: 14/625,538

(22) Filed: Feb. 18, 2015

(51) Int. Cl.
*E03C 1/04* (2006.01)
*E03C 1/046* (2006.01)

(52) U.S. Cl.
CPC ..... *E03C 1/0465* (2013.01)

(58) Field of Classification Search
CPC .. A47K 5/1202; A47K 5/1204; E03C 1/0465; E03C 1/046; B05B 7/2443; B05B 1/16
USPC ..... 239/315, 316
See application file for complete search history.

(56) References Cited

U.S. PATENT DOCUMENTS 1,623,248 A 4/1927 Joseph et al.
2,625,176 A * 1/1953 Williams et al. ..... 137/893
3,964,686 A * 6/1976 Lopez ..... 239/74
5,135,173 A * 8/1992 Cho ..... 239/305
5,857,594 A 1/1999 Ozturk
6,827,294 B1 12/2004 Fan et al.
7,770,244 B2 8/2010 Yeh
2004/0069802 A1 4/2004 Frankel
2005/0205697 A1 * 9/2005 Lo ..... 239/592
2014/0053332 A1 2/2014 Cole

* cited by examiner

*Primary Examiner* — Janie Christiansen
(74) *Attorney, Agent, or Firm* — Richard C Litman

(57) ABSTRACT

The water/soap dispenser includes a housing configured to be mounted to existing faucets. An internal pipe assembly within the housing directs water from the faucet and a cleaning product from a pump assembly coupled to the pipe assembly to the outlet of the dispenser. A valve assembly is also coupled to the pipe assembly to selectively open and close passage of water through the pipe assembly. A universal actuator is pivotally mounted to the valve assembly, and selective operation of the universal actuator facilitates substantially concurrent activation of the valve assembly to open water flow and the pump assembly to dispense a certain amount of cleaning product into the water flow. A dial assembly is rotatably mounted to the housing and includes one or more outlet ports facilitating a different flow character to the liquid being dispensed, as determined by the user.

15 Claims, 6 Drawing Sheets

WATER/SOAP DISPENSER

BACKGROUND OF THE INVENTION

1. Field of the Invention

The present invention relates to plumbing accessories, and particularly to a water/soap dispenser adapted to be coupled to taps or faucets that provides selective dispensing of water, soap, and/or a water-soap mixture for easy and convenient cleaning.

2. Description of the Related Art

Washbasins in many households and buildings are typically surrounded by necessary clutter, such as soaps, toiletries, and other implements for grooming and cleaning. Unfortunately, most of these types of items are generally unsecured and can be easily misplaced. Moreover, they tend to occupy much of the limited counter space available around the washbasin.

There is a need for an integrated device that permits selective dispensing of washing liquid and/or soap with a universal control for easy operation to thereby increase convenience for cleaning and conserve space. Thus, a water/soap dispenser solving the aforementioned problems is desired.

SUMMARY OF THE INVENTION

The water/soap dispenser includes a housing configured to be mounted to existing faucets. An internal pipe assembly within the housing directs water from the faucet and a cleaning product from a pump assembly coupled to the pipe assembly to the outlet of the dispenser. A water valve assembly is also coupled to the pipe assembly to selectively open and close for passage of water through the pipe assembly. A universal actuator is coupled to the water valve assembly, and selective operation of the universal actuator facilitates substantially concurrent activation of the water valve assembly to open water flow and the pump assembly to dispense a certain amount of cleaning product into the water flow. A dial assembly is rotatably mounted to the housing and includes one or more outlet ports, each outlet port facilitating a different flow character to the liquid being dispensed, as determined by the user.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1A:
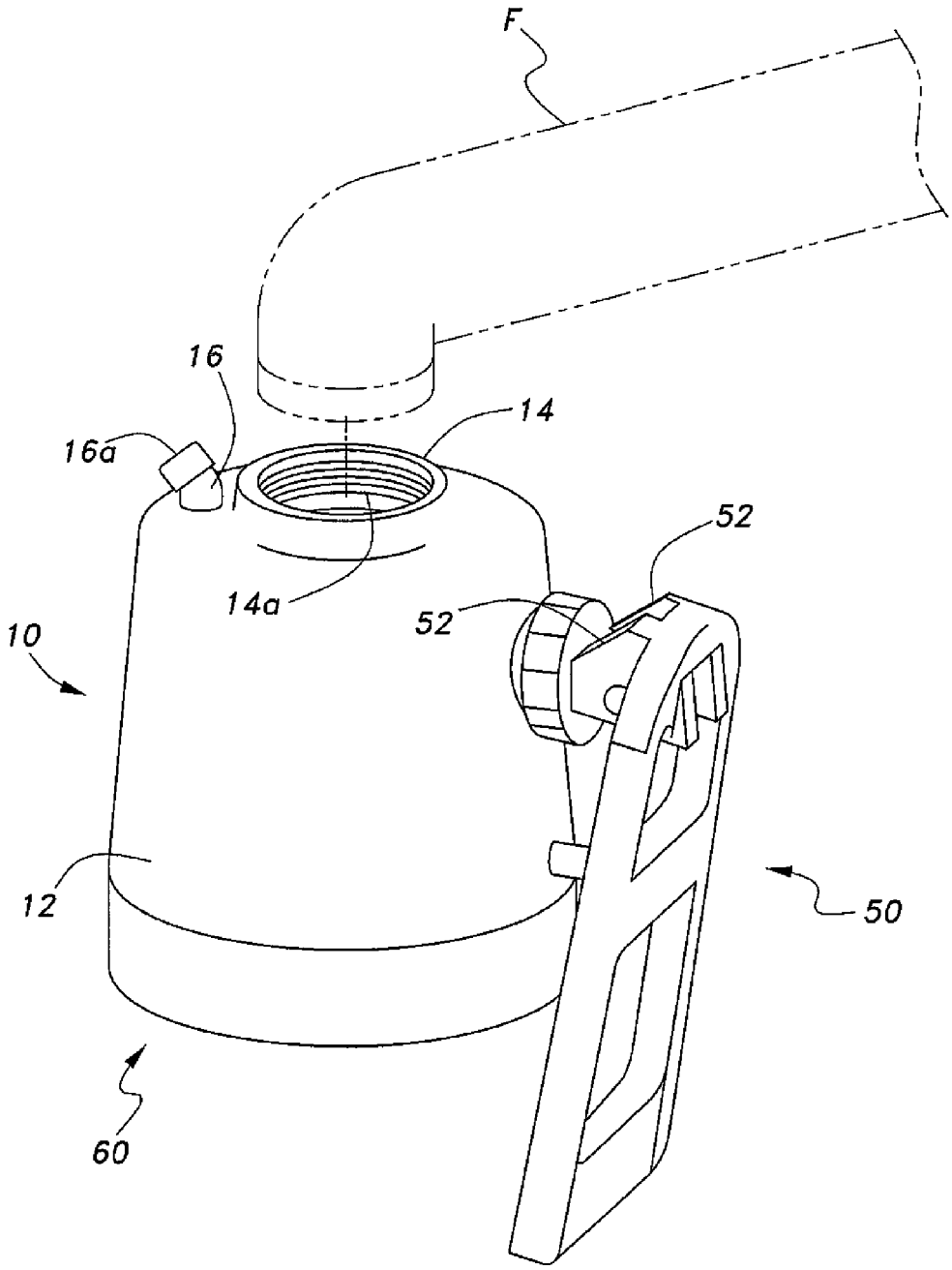
FIG. 1A is an environmental, perspective view of a water/soap dispenser according to the present invention.
Figure 1B:
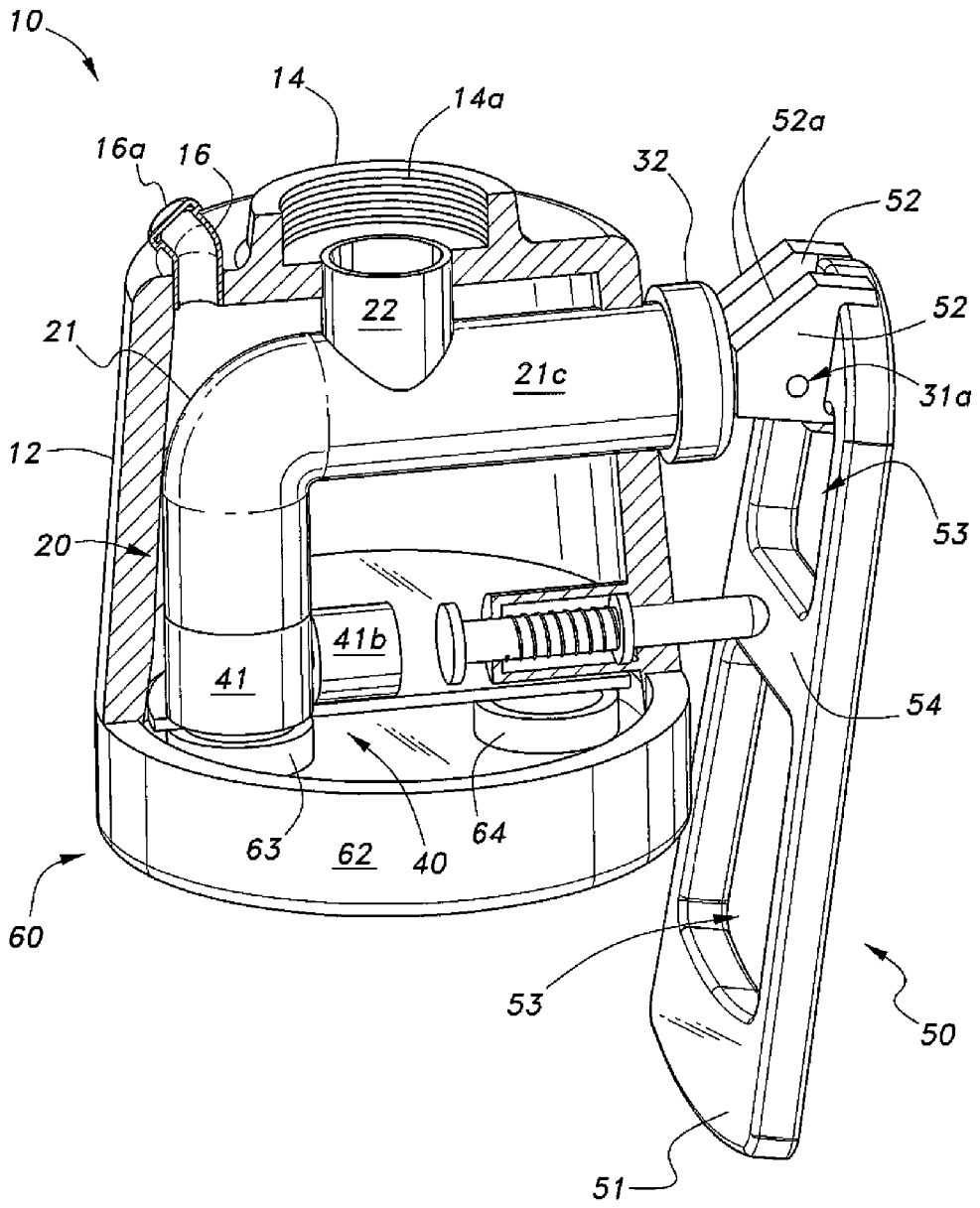
FIG. 1B is a perspective view of the water/soap dispenser of FIG. 1A, shown with portions of the housing removed and portions broken away and in section to show the internal components.

The water/soap dispenser, a first embodiment of which is generally referred to by the reference number 10, provides an attachment to conventional or existing faucets or taps that dispenses water and/or cleaning products in an easy manner. The water/soap dispenser 10 includes a body or housing 12 adapted to be mounted or installed onto the outlet end of a conventional or existing faucet or tap, an internal pipe assembly 20 inside the housing 12 for directing water and/or the cleaning product to be dispensed, a water valve assembly 30 coupled to the pipe assembly 20 to facilitate selective dispensing of water, a pump assembly 40 coupled to the pipe assembly 20 to facilitate selective dispensing of the cleaning product, a universal actuator 50 for actuating the water valve assembly 30 and/or the pump assembly 40, and a dial assembly 60 coupled to the housing 12 for selective positioning of outlet openings to facilitate desired flow out of the water/soap dispenser 10.

As best seen in FIGS. 1A, 1B, 2, and 3, the housing 12 is a substantially hollow construction shaped to form an internal chamber or reservoir 13. In this instance, the housing 12 forms a general frustoconical shape. The internal chamber 13 houses the pipe assembly 20 and defines space for collecting and holding a cleaning product to be dispensed, such as liquid soap S of various types. The housing 12 includes an integral mounting collar 14 and a product supply spout 16, both extending from the top of the housing 12, and an outlet 15 formed at the bottom of the housing 12.

The mounting collar 14 is preferably provided with internal threads 14*a* to facilitate selective mounting onto the outlet end of most conventional faucets or taps F in place of the aerator. When mounted, the mounting collar 14 defines an inlet through which water from the faucet F can flow through the housing 12. The mounting collar 14 can also be provided with other coupling mechanisms that conform to various other faucet configurations, such as outer threads for faucet ends with internal threads, and clamp mechanisms.

The product supply spout 16 is preferably a curved, hollow pipette, pipe, or straw projecting from the top of the housing 12. The product supply spout 16 communicates with the chamber 13 and forms an access port for the user to pour the desired liquid product into the chamber 13. The product supply spout 16 includes a cap 16*a* to cover and seal the opening of the product supply spout 16 when not in use. The product supply spout 16 can be configured in various shapes other than curved without departing from the scope of the invention. Additionally, the product supply spout 16 can be configured as a port opening substantially flush or extending a short distance from the housing 12, shorter than shown in the drawings, so long as the product supply spout 16 provides access to facilitate feeding or refill of the chamber 13 as needed or desired. The product supply spout 16 is preferably disposed at or near the top of the housing 12 to maximize the holding capacity of the liquid soap S in the chamber 13.

The cap 16*a* can be selectively coupled to the product supply spout 16 vis-à-vis friction-fit or threaded engagement. Moreover, the cap 16*a* can be provided with a chain, a dongle arrangement, or other tether connected to the product supply spout 16 to assist in preventing inadvertent misplacement or loss of the cap 16*a* by the user.

The internal pipe assembly 20 includes an elongate elbow pipe 21 having a first end 21*a* projecting a short distance from a side surface of the housing 12 and a second end 21*b* extending towards the outlet 15 at the bottom of the housing 12 and communicating therewith. An intermediate pipe 22 extends from the elbow pipe 21 and communicates with the inlet defined by the mounting collar 14 and the internal passageway of the elbow pipe 21, thereby providing a flow path between the faucet F and the elbow pipe 21. An internal baffle 23 divides a leg section 21*c* of the elbow pipe 21 and includes a pass-through opening 23*a* therein. The leg section 21*c* is a part of the elbow pipe 21 that extends outside the housing 12 and includes the first end 21*a*. The pass-through opening 23*a* interacts with the water valve assembly 30 to selectively permit water to flow from the faucet F through the elbow pipe 21 and out of the housing 12. Thus, the intermediate pipe 22 permits passage of water from the faucet F to the leg section 21*c*, and the pass-through opening 23*a* permits passage of water from the leg section 21*c* towards the outlet 15.

Figure 3:
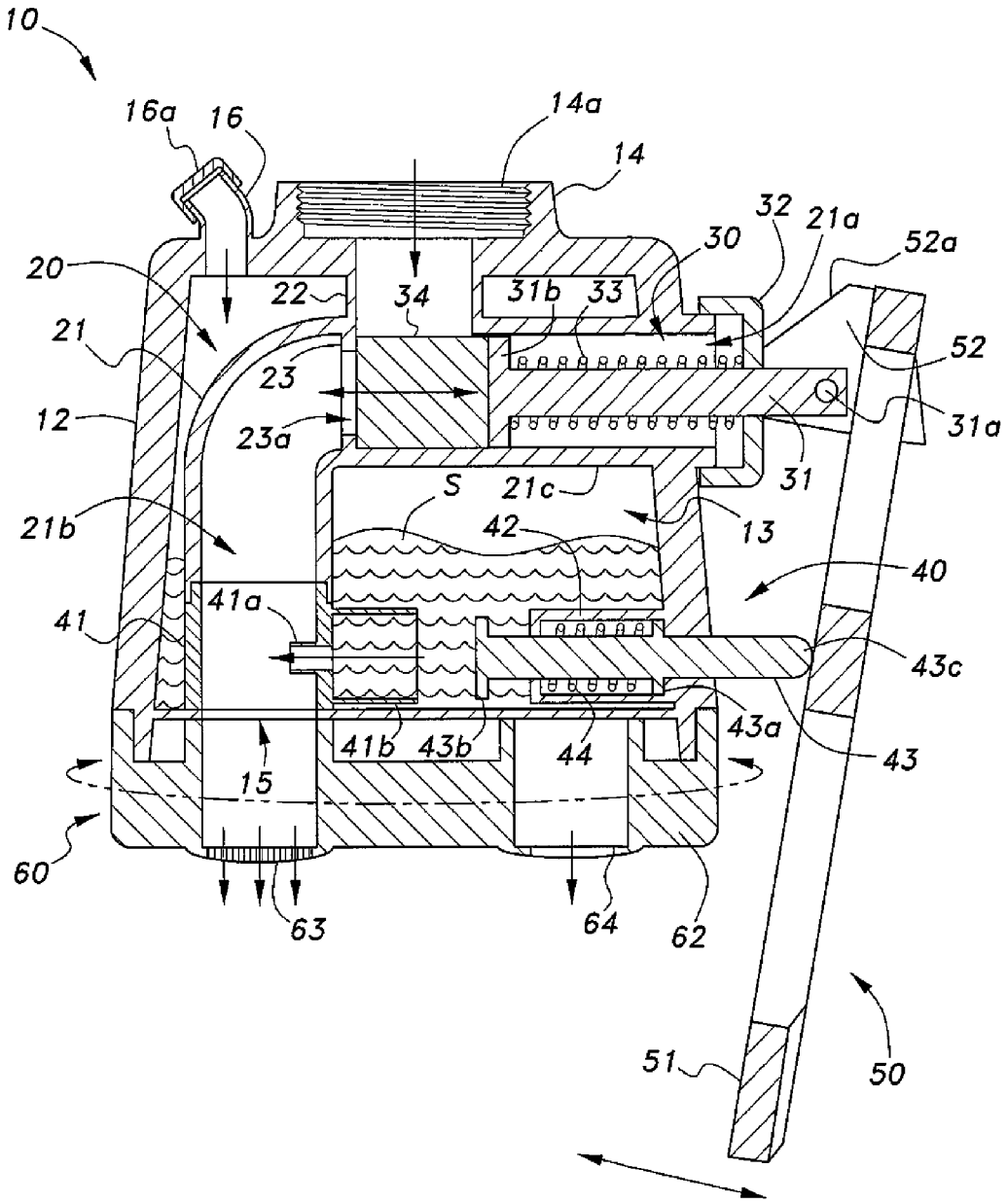
FIG. 3 is a side view in section of the water/soap dispenser of FIG. 1A.

As best seen in FIG. 3, the water valve assembly 30 is operatively coupled to the leg section 21*c* and configured to open or close the flow path between the inlet at the mounting collar 14 and the outlet 15 upon selective operation of the universal actuator 50. The water valve assembly 30 includes an elongate valve stem 31 slidably mounted inside the leg section 21*c* and reciprocable therein. The first end of the valve stem 31 extends outside the housing 12 past the first end 21*a* of the elbow pipe 21. A screw cap 32 is threadably mounted to the first end 21*a* of the elbow pipe 21 and includes a through-hole permitting the first end of the valve stem 31 to pass through. The screw cap 32 secures the valve stem 31 within the leg section 21*c*. The through-hole thereof is coaxially aligned with the hollow interior of the leg section 21*c*, which insures that reciprocating movements of the valve stem 31 follows the proper and desired path.

The valve stem 31 is preferably configured as a plunger or piston having a head 31*b* disposed at the opposite or second end of the valve stem 31. The head 31*b*, which can also be referred to as a "piston head," "plunger head," or "valve head," is preferably dimensioned and configured to conform to the interior dimensions and shape of the leg section 21*c*. This arrangement stabilizes the second end of the valve stem 31, while the first end thereof is stabilized by the screw cap 32. Moreover, relatively close tolerances can be maintained between the head 31*b* and the inner surface of the leg section 21*c* to substantially prevent wobbling movement of the valve stem 31 during reciprocation.

A biasing mechanism 33, such as a coil or tension spring, is mounted on the valve stem 31 between the head 31*b* and the inner surface of the screw cap 32. The biasing mechanism 33 normally biases the valve stem 31 into a closed state, which will be further described herein.

A valve plug 34 is fixed to the outer face of the head 31*b*. The valve plug is dimensioned and configured to cover or obstruct the inlet from the mounting collar 14 and the pass-through opening 23*a*. Due to this connection to the head 31*b*, the valve plug is movable between obstructed and unobstructed positions corresponding to the closed and open states of the valve stem 31. Thus, selective reciprocation of the valve stem 31 opens or closes the inlet and the pass-through opening 23*a*, allowing selective flow or dispensing of water therethrough. The biasing mechanism 33 maintains the valve plug 34 in the closed position (shown in FIG. 3) due to the fixed connection of the valve plug 34 to the head 31*b*. Additionally, since the valve plug 34 selectively closes and opens the passage for dispensing water, and since close tolerances must be maintained to perform these functions, the valve plug 34 is preferably dimensioned and configured to conform to the interior dimensions and configuration of the leg section 21*c*. This arrangement also allows for a variety of dimensions and shapes for the head 31*b*, as desired by the user. As long as a fixed connection exists between the head 31*b* and the valve plug 34, it is contemplated that the head 31*b* can be provided in smaller dimensions and configurations other than shown in the drawings because the head 31*b* will be stabilized by the connection to the valve plug 34.

While the valve assembly 30 facilitates dispensing of water, the pump assembly 40 facilitates substantially concurrent dispensing of a desired cleaning product, such as liquid soap S, for washing hands, dishes, clothes, and the like. The pump assembly 40 includes a pump outlet coupling 41 mounted to the outlet 21*b* of the elbow pipe 21. The pump outlet coupling 41 acts as an interface between the chamber 13, the second end 21*b* of the elbow pipe 21, and the outlet 15 to allow the contents of the chamber 13 to dispense into the water flowing through the elbow pipe 21. The mounting of the pump outlet coupling 41 can be facilitated by any known conventional means, such as threads, friction-fit, clamps, and the like, and the mounting can be detachable or fixed. Additionally, the pump outlet coupling 41 can be provided as a unitary feature of the elbow pipe 21.

The pump outlet coupling 41 includes an outlet pipe 41*a* extending into the interior of the pump outlet coupling 41. The outlet pipe 41*a* communicates with an intermediate reservoir 41*b* extending into the chamber 13 or in a direction opposite from the outlet pipe 41*a*. During use, the intermediate reservoir 41*b* holds a small amount of the liquid soap S that will be pumped through the outlet pipe 41*a*.

The pump assembly 40 also includes an elongate piston casing 42 extending into the chamber 13 from the interior wall of the housing 12 spaced away from, and in coaxial alignment with, the intermediate reservoir 41*b*. The piston casing 42 is preferably configured as a substantially cylindrical housing having one end wall or proximal end wall defined by the inner wall of the housing 12 and the opposite end wall at the distal end thereof.

An elongate piston 43 is reciprocally mounted within the piston casing 42, and the piston 43 is configured to reciprocate between start and end positions during a pumping operation. The piston 43 includes a first end 43*c* that extends outside the housing 12*a* predetermined distance through the proximal end wall of the piston casing 42, an abutment flange 43*a* disposed between opposite ends of the piston 43, and a piston head 43*b* disposed at a second or opposite end, the piston head 43*b* extending outside the piston casing 42. The abutment flange 43*a* limits reciprocating movement of the piston 43 along the length of the piston casing 42. Additionally, a biasing mechanism 44 is disposed between the abutment flange 43*a* and the distal end wall of the piston casing 42. The biasing mechanism 44 can be a coil spring or a tension spring similar to the biasing mechanism 33, and the biasing mechanism 33 normally biases the piston 43 towards the start position, as shown in FIG. 3.

In use, actuation of the piston 43 forces the piston head 43*b* to enter into the intermediate reservoir 41*b* as the piston 43 travels from the start position to an end position within the intermediate reservoir 41*b*. This action creates a pressure head that acts against any liquid soap S trapped inside the intermediate reservoir 41*b* and forces the trapped liquid soap S to eject out of the outlet pipe 41*a*.

Figure 2:
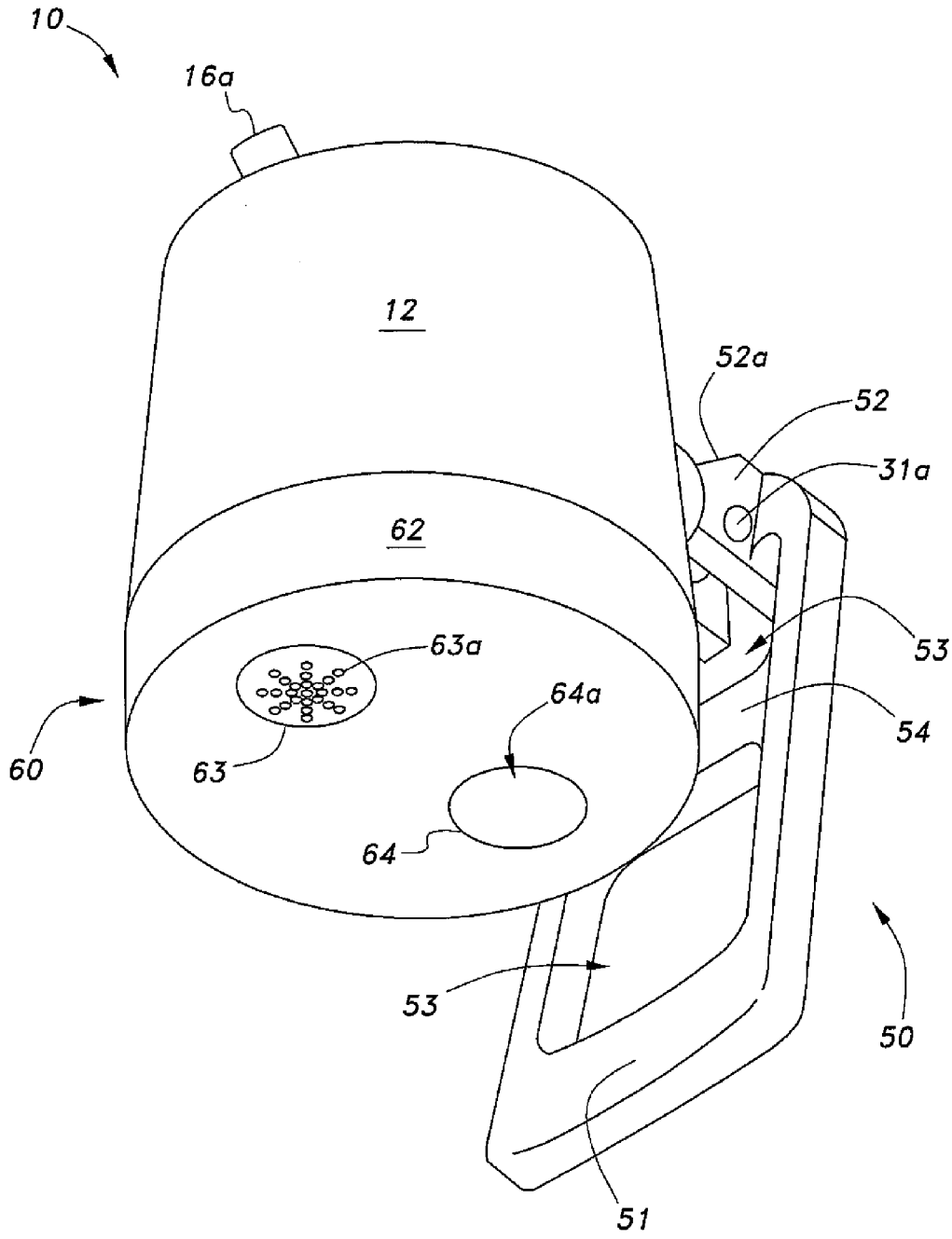
FIG. 2 is a perspective view of the water/soap dispenser of FIG. 1A as seen from the bottom of the dispenser.

The universal actuator 50 facilitates substantially concurrent actuation of the valve assembly 30 and the pump assembly 40, as well as selective actuation of either assembly. As best seen in FIGS. 1A, 2, and 3, the universal actuator 50 includes an elongate handle or lever 51 having a first end pivotally mounted on a pivot pin 31*a* at the first end of the valve stem 31. The first end of the lever 51 includes a pair of spaced actuating flanges or fins 52 straddling the first end of the valve stem 31, on which the pivot pin 31*a* is mounted. The lever 51 also includes a pair of cutouts 53 separated by a cross member 54. The cutouts 53 minimize material and weight for the lever 51. It is also contemplated that the lever 51 can be provided as a relatively imperforate structure.

Each actuating fin 52 is preferably trapezoidal in shape, presenting at least two side edges extending at different respective angles. These side edges allow different actuations to occur, depending on the rotation of the lever 51, and they act as angular cams. For example, in the position shown in FIG. 3, the actuating fins 52 have a vertical straight side edge abutting the outer surface of the screw cap 32. Pulling the lever 51 to the left (or clockwise) forces the actuating fins 52 to rotate about the pivot pin 31*a* and pull the valve stem 31 against the bias of the biasing mechanism 33, the bottom corner of each respective actuating fin 52 acting as a moving fulcrum. The connected valve plug 34 travels to the right, thereby opening the passage for water to flow from the faucet F to the outlet 15. At the same time, the cross member 54 abuts against the first end 43*c* of the piston 43 to depress or push the piston 43 to the left against the bias of the biasing mechanism 44. This forces the piston head 43*b* to enter the intermediate reservoir 41*b* and dispense a certain amount of liquid soap S out of the outlet pipe 41*a*. Thus, the substantially concurrent movements of the valve stem 31 and the piston 43 open passages for the water to flow through the inlet defined by the mounting collar 14 towards the outlet 15 and dispense liquid soap S into the water flow stream.

In another example, the lever 51 can be pulled in the counter-clockwise direction so that the actuating fins 52 will rotate about the pivot 31*a* and pull the valve stem 31 connected thereto, the upper left corner of the respective actuating fin 52 acting as a fulcrum. This action causes the connected valve plug 34 to move from the normally closed position to the open position. The lever 51 can be rotated until the angled side edge 52*a* of each actuating fin 52 abuts the screw cap 32, thereby fixing or setting the open state of the valve assembly 30. In this example, the counter-clockwise actuation of the lever 51 facilitates water flow only.

The universal actuator 50 also permits independent operation of the pump assembly 40. The user can push the lever 51 away from contact with the first end 43*c* of the piston 43 and manually depress the piston 43 from the first end 43*c* to dispense the liquid soap S independent of the water.

The dial assembly 60 is rotatably coupled to the bottom of the housing 12 and includes one or more dispensing ports for the water, soap, and/or water-soap mixture. The rotatable connection between the dial assembly 60 and the housing 12 can be facilitated by any conventional means known in the art, such as friction-fit couplings, snap-fit couplings, and the like. The dial assembly 60 permits the user to selectively control the flow characteristic of the liquid dispensing out of the water/soap dispenser 10.

As best seen in FIGS. 2 and 3, the dial assembly includes a substantially disk-shaped dial housing 62 and has a first dispensing port 63 and a second dispensing port 64 disposed at the bottom thereof. The disk-shape of the dial housing 62 is preferred in order to conform to the shape of the bottom portion of the housing 12 and for relatively easy operation in rotating the dial housing 62. Each first dispensing port 63 and second dispensing port 64 is defined by a passage extending through the dial housing 62 and arranged so that the respective passage aligns with the outlet 15 of the housing 12 upon selective rotation of the dial housing 62 with respect to the housing 12. Moreover, each dispensing port is preferably configured to facilitate a different flow character to the contents or liquid flowing out of the elbow pipe 21. For example, the outlet end of the first dispensing port 63 includes a plurality of perforations 63*a* to facilitate a shower or sprinkling effect to the liquid flowing through the outlet 15. The second dispensing port 64 includes an unobstructed opening 64*a* for normal or standard flow. The dial housing 62 can be provided with locking features, such as detents and the like, to fix or set the angular intervals at which the respective dispensing ports are aligned with the outlet 15.

Figure 4:
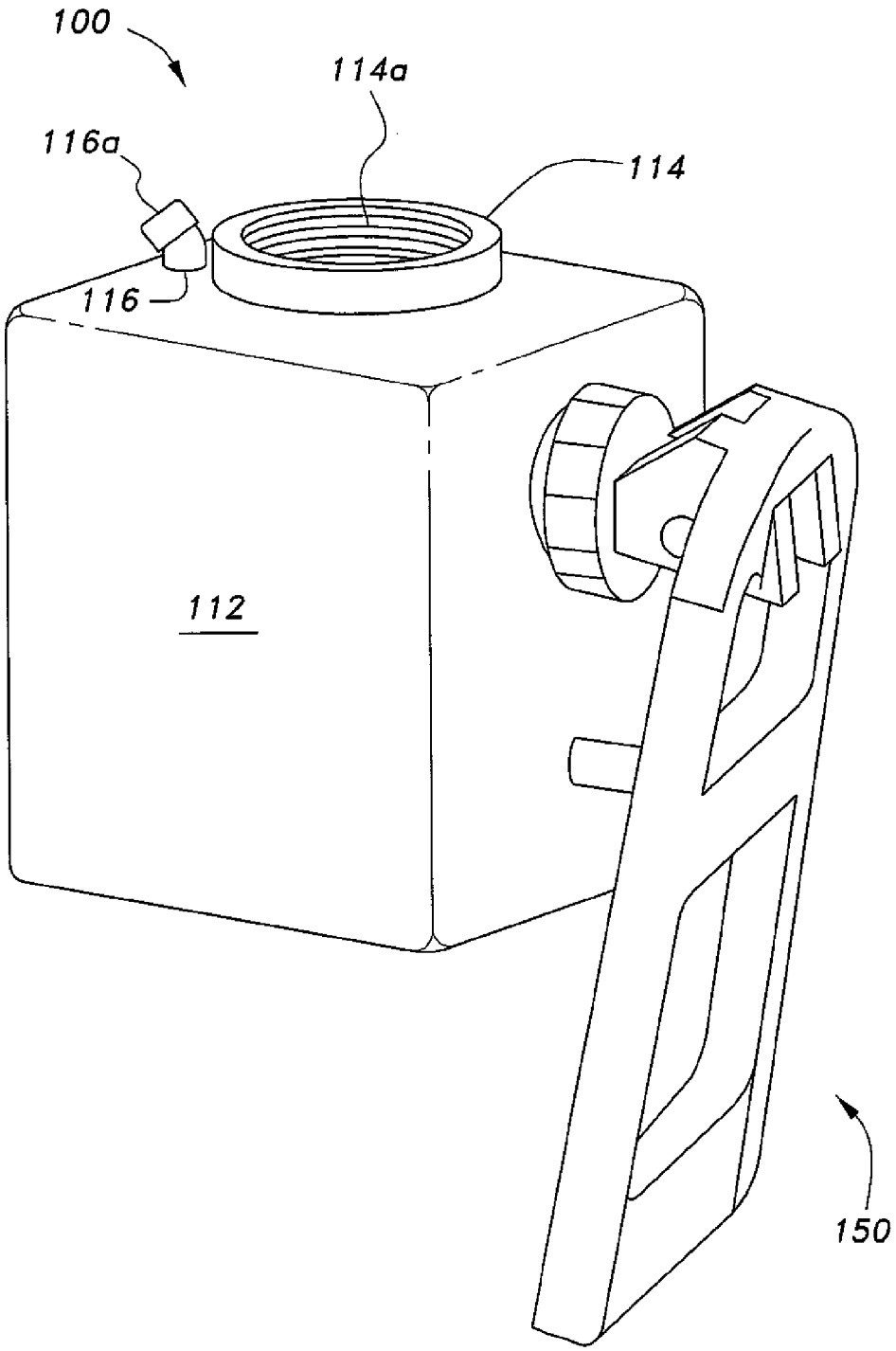
FIG. 4 is a perspective view of a second embodiment of a water/soap dispenser according to the present invention.
Figure 5:
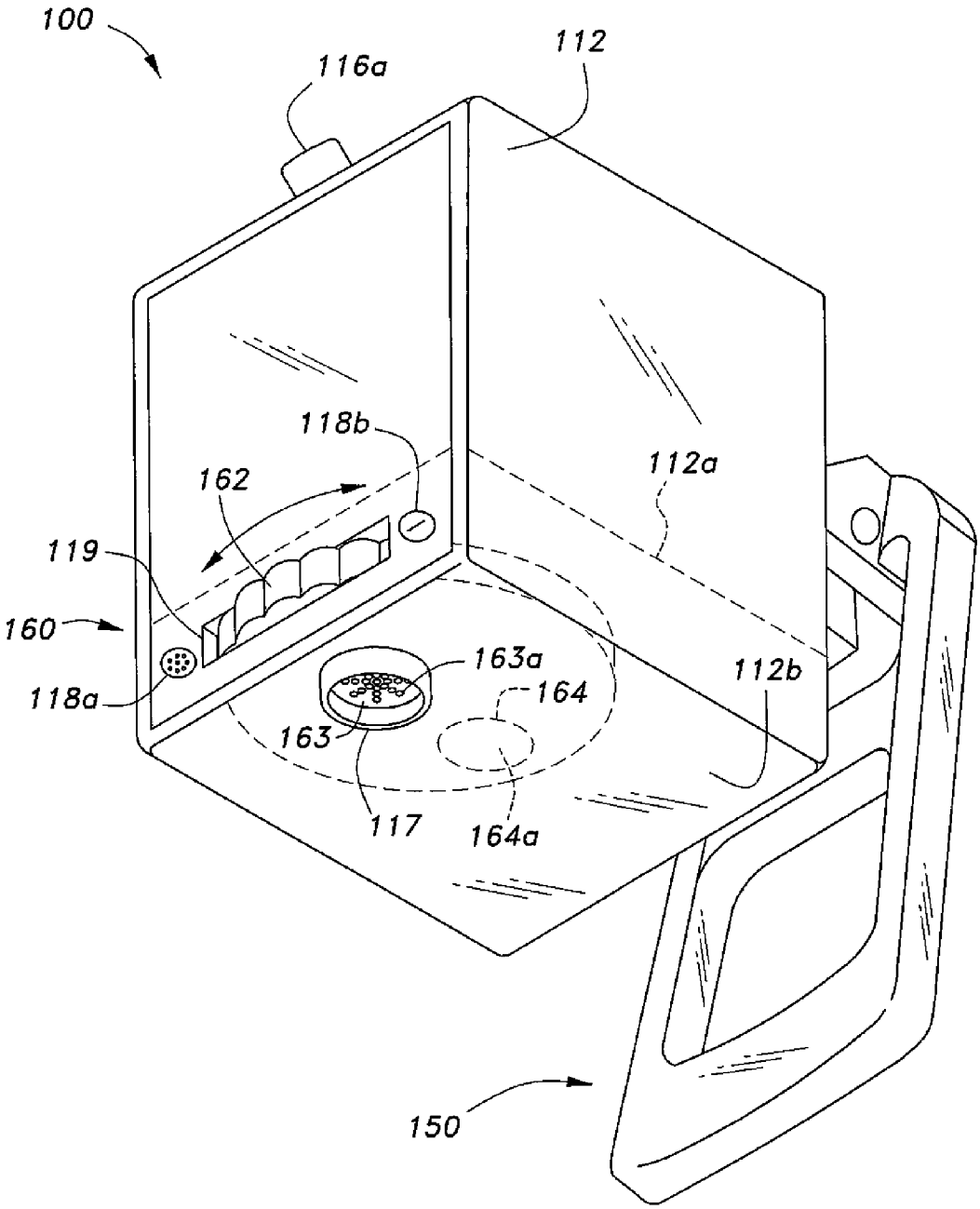
FIG. 5 is a perspective view of the water/soap dispenser of FIG. 4 as seen from the bottom of the dispenser.

A second embodiment of a water/soap dispenser 100 is shown in FIGS. 4 and 5. In this embodiment, the water/soap dispenser 100 includes a different dialing arrangement. In all other respects, the water/soap dispenser 100 functions in substantially the same manner as the previously described water/soap dispenser 10, and similar reference numbers in the "100" series have been used to reference similar features. Thus, the following description will be mostly concerned with differences therebetween.

As best shown in FIG. 5, the water/soap dispenser 100 includes a box-shaped housing 112 and a dial assembly 160 operatively disposed within the housing 112. The dial assembly 160 includes a dial 162 and one or more dispensing ports, such as a first dispensing port 163 and a second dispensing port 164, disposed on the dial 162. The rotatable dial 162 can be mounted to the housing 112 in any conventional manner known in the art, similar to the dial housing 62 described above.

The internal components of the water/soap dispenser 100 are substantially the same as the water/soap dispenser 10, and each first dispenser port 163 and second dispenser port 164 is arranged on the dial 162 so that selective rotation of the dial 162 over a predetermined arc will align the selected dispenser port with the outlet 15. Each dispensing port is preferably configured to facilitate a different flow character to the contents or liquid flowing out of the elbow pipe 21. For example, the outlet end of the first dispensing port 163 includes a plurality of perforations 163*a* to facilitate a shower or sprinkler effect to the liquid flowing through the outlet 15. The second dispensing port 164 includes an unobstructed opening 164*a* for normal or standard flow.

The housing 112 includes various features to facilitate operation of the dial assembly 160. One side of the housing 112, preferably the side that conveniently faces the user, is provided with an elongate slot 119. A portion of the dial 162 extends outward through the slot 119 to provide manual access to the dial 162 for selective rotation thereof. Indicia, such as a first or sprinkler symbol 118*a* and a second or normal symbol 18*b*, can be provided adjacent the slot to visually assist the user in determining which direction to rotate the dial 162 for the desired flow characteristic.

The housing 112 also includes an inner bottom panel 112*a*, which has the outlet 15 formed thereon, and an outer bottom panel 112*b*. A housing outlet port 117 depends from the outer bottom panel 112*b*. The housing outlet port 117 is fixed and coaxially aligned with the outlet 15. In use, after the desired first outlet port 163 or second outlet port 164 has been fixed in place by the user, the outlet 15, the selected outlet port 163 or 164, and the housing outlet port 117 are all aligned so that the liquid flowing through the outlet 15 feeds into the selected outlet port 163 or 164 and out through the housing outlet port 117. Thus, selective operation of the dial 162 determines the type of flow exiting the outlet port 117. As with the dial housing 62, the dial 162 may be provided with a detent mechanism and the like to lock the dial 162 at predetermined angular intervals corresponding to the aligned positions of the outlet ports 163, 164.

It is to be understood that the water/soap dispenser 10, 100 encompasses a variety of alternatives. For example, it is contemplated that the water/soap dispenser 10, 100 can be provided with various sealing mechanisms, such as O-rings, gaskets, and the like, to prevent undesirable leaks in the overall dispenser and/or in select components of the dispenser. Moreover, the water/soap dispenser 10, 100 can be constructed from a variety of materials, such as plastic, PVC, metal, composites, and combinations thereof. Furthermore, the chamber 13 can be utilized to hold other liquid or semi-liquid products, such as lotions, oils, emulsions, and the like, to be dispensed along with the water. Conversely, the housing 12, 112 can be attached to sources of liquid other than water, so long as the mounting hardware permits.

It is to be understood that the present invention is not limited to the embodiments described above, but encompasses any and all embodiments within the scope of the following claims.

I claim:

1. A water/soap dispenser, comprising:

a substantially hollow housing adapted to be mounted to a faucet, the housing having a top, a bottom, an outlet for liquid to pass through, and a hollow chamber, the chamber adapted to hold a cleaning product therein;

a pipe assembly including an elongate elbow pipe having a first end extending outside said housing, a leg section extending through said housing, the leg section including the first end, and a second end extending towards the outlet of said housing and communicating therewith, an intermediate pipe extending orthogonal to the leg section and opening in the top of said housing, the intermediate pipe being in fluid communication with the leg section, and an internal baffle disposed between the leg section and the second end of the elbow pipe, the baffle having a pass-through opening defined therein;

the pipe assembly disposed inside the chamber, the pipe assembly defining a passage for flow of water from the faucet towards the outlet and dispensing of the cleaning product into the water flow;

a water valve assembly coupled to the pipe assembly, the water valve assembly selectively opening and closing to control flow of the water from the faucet through the pipe assembly;

a pump assembly coupled to the pipe assembly, the pump assembly selectively dispensing the cleaning product into the water flow;

the pump assembly including:

a pump outlet coupling having, an outlet pipe extending into the pump outlet coupling, and an intermediate reservoir extending out of the pump outlet coupling, the intermediate reservoir being coaxially aligned with the outlet pipe and communicating therewith, the intermediate reservoir being adapted to trap a quantity of the cleaning product therein to be dispensed through the outlet pipe during a pumping operation, the pump outlet coupling coupled to the second end of the elbow pipe;

an elongate piston casing extending into the chamber from an interior side wall of the housing, the piston casing being spaced from and in coaxial alignment with the intermediate reservoir;

an elongate piston reciprocally mounted within the piston casing, the piston being adapted to reciprocate between start and end positions, the elongate piston having a first end and an opposing second end, the first end of the piston extending outside the housing, an abutment flange disposed between the opposing ends of the piston, and a piston head disposed at the second end of the piston, the abutment flange limiting movement of the piston to be within the piston casing; and a biasing spring disposed inside the piston casing, the biasing spring normally biasing the piston into the start position;

wherein selective reciprocation of the piston moves the piston head into and out of the intermediate reservoir to forcibly eject the cleaning product through the outlet pipe, the start position corresponding to a position outside the intermediate reservoir, the end position corresponding to a position inside the intermediate reservoir; and a universal actuator pivotally mounted to the valve assembly;

wherein selective operation of the universal actuator substantially concurrently activates the valve assembly and the pump assembly to permit water flow through the pipe assembly and to dispense the cleaning product into the water flow.

2. The water/soap dispenser according to claim 1, wherein said housing comprises a mounting collar extending from the top of said housing, the mounting collar having threads adapted for engaging threads on the faucet to mount the water/soap dispenser.

3. The water/soap dispenser according to claim 1, wherein the housing further comprises a product supply spout extending from the top of said housing, the product supply spout communicating with said chamber to fill said chamber with the cleaning product.

4. The water/soap dispenser according to claim 3, further comprising a cap detachably mounted to said product supply spout.

5. The water/soap dispenser according to claim 1, wherein said valve assembly comprises:

an elongate valve stem reciprocally mounted inside the leg section of said elbow pipe, the valve stem having a first end and a second end, the first end of the valve stem extending outside said housing past the first end of said elbow pipe, the valve stem being reciprocal between open and closed states to selectively open and close the flow of water through said elbow pipe;

a head formed at the second end of the valve stem;

a valve plug fixed to the head, the valve plug being selectively movable between a position blocking the flow of water through said intermediate pipe into said elbow pipe when the valve stem is in the closed state and a position permitting the flow of water through said intermediate pipe into said elbow pipe when the valve stem is in the open state;

a biasing spring disposed inside the leg section, the biasing spring normally biasing the valve stem into the closed state; and a screw cap mounted to the first end of said elbow pipe, the screw cap securing and sealing the first end of the valve stem;

wherein selective reciprocation of the valve stem obstructs water flow between said intermediate pipe and the pass-through opening in said internal baffle in the closed state and permits water flow between said intermediate pipe and through the pass-through opening in said internal baffle in the open state.

6. The water/soap dispenser according to claim 5, wherein said universal actuator comprises:

a pivot pin mounted on the first end of said valve stem;

an elongate lever having a first end pivotally mounted on the pivot pin; and an intermediate cross member disposed on the lever, the cross member adapted to abut the first end of said piston;

wherein selective pivotal movement of the lever in one direction substantially concurrently pulls said valve stem to open water flow between the faucet and said elbow pipe and pushes said piston and said cross member to pump and dispense the cleaning product into the water flow.

7. The water/soap dispenser according to claim 6, wherein the first end of said elongate lever comprises a pair of spaced, elongate actuating fins straddling the pivot pin, each of the actuating fins having at least one side disposed at an angle different from another side edge.

8. The water/soap dispenser according to claim 1, further comprising a dial assembly coupled to said housing.

9. The water/soap dispenser according to claim 8, wherein said dial assembly comprises:

a dial housing rotatably coupled to said housing; and a plurality of dispensing ports formed on the dial housing, the dispensing ports being alternately alignable with the outlet of said housing upon selective rotation of the dial housing, each of the dispensing ports being adapted for permitting a liquid dispensing pattern different from the other.

10. The water/soap dispenser according to claim 9, wherein said dispensing ports comprise:

a first dispensing port having a plurality of perforations to dispense a liquid spray; and a second dispensing port having an unobstructed opening to produce a concentrated liquid stream.

11. The water/soap dispenser according to claim 8, wherein said housing includes an inner bottom panel and an outer bottom panel, the outlet of said housing being formed in the inner bottom panel, said dial assembly comprising:

a dial rotatably coupled to the inner bottom panel of said housing; and a plurality of dispensing ports formed in the dial, the dispensing ports being alternately alignable with the outlet of said housing upon selective rotation of the dial, each of the dispensing ports being adapted for permitting a liquid dispensing pattern different from the other.

12. The water/soap dispenser according to claim 11, wherein said dispensing ports comprise:

a first dispensing port having a plurality of perforations to dispense a liquid spray; and a second dispensing port having an unobstructed opening to produce a concentrated liquid stream.

13. The water/soap dispenser according to claim 12, wherein said housing further comprises:

an elongate slot formed on a side of said housing, a portion of said dial protruding out of said housing through the elongate slot for manipulation by a user;

indicia adjacent the elongate slot to visually indicate a direction of rotation to align one of the dispensing ports; and a housing outlet port depending from the outer bottom panel of said housing, the dial being disposed between the outlet of said housing and the housing outlet port, the housing outlet port being coaxially aligned with the outlet of said housing, the housing outlet port permitting exit of liquid when one of said dispensing ports is aligned with the outlet of said housing and the housing outlet port.

14. A water/soap dispenser, comprising:

a substantially hollow housing adapted to be mounted to a faucet, the housing having a top, a bottom, an outlet for liquid to pass through, and a hollow chamber, the chamber adapted to hold a cleaning product therein;

a pipe assembly disposed inside the chamber, the pipe assembly defining a passage for flow of water from the faucet towards the outlet and dispensing of the cleaning product into the water flow;

a water valve assembly, including a valve stem having a first end extending out of said housing, the water valve assembly coupled to the pipe assembly, the water valve assembly selectively opening and closing to control flow of the water from the faucet through the pipe assembly;

a pump assembly, including a piston having a first end extending out of said housing, the pump assembly coupled to the pipe assembly, the pump assembly selectively dispensing the cleaning product into the water flow; and a universal actuator pivotally mounted to the valve assembly, the universal actuator including:

wherein said water valve assembly includes a valve stem having a first end extending out of said housing and said pump assembly includes a piston having a first end extending out of said housing, said universal actuator comprising:

a pivot pin mounted to the first end of said valve stem;

an elongate lever having a first end pivotally mounted on the pivot pin; and an intermediate cross member disposed on the lever, the cross member abutting the first end of said piston;

wherein selective pivoted movement of the lever in one direction substantially concurrently pulls said valve stem to open water flow between the faucet and said pipe assembly and pushes said piston and said cross member to pump and dispense the cleaning product into the water flow; and wherein selective operation of the universal actuator substantially concurrently activates the valve assembly and the pump assembly to permit water flow through the pipe assembly and to dispense the cleaning product into the water flow.

15. A water/soap dispenser, comprising:

a substantially hollow housing adapted to be mounted to a faucet, the housing having a top, a bottom, an outlet for liquid to pass through, and a hollow chamber, the chamber being adapted to hold a cleaning product therein;

a pipe assembly disposed inside the chamber, the pipe assembly defining a conduit for flow of water from the faucet towards the outlet and for dispensing the cleaning product into the water flow;

a water valve assembly, including a valve stem having a first end extending out of said housing, coupled to the pipe assembly, the water valve assembly selectively opening and closing to control passage of the water from the faucet through the pipe assembly;

a pump assembly, including a piston having a first end extending out of said housing, coupled to the pipe assembly, the pump assembly selectively dispensing the cleaning product into the water flow;

a universal actuator pivotally mounted to the valve assembly, including a pivot pin mounted to the first end of the valve stem, an elongate lever having a first end pivotally mounted on the pivot pin, and an intermediate cross member disposed on the lever, the cross member abutting the first end of the piston; and a dial assembly rotatably coupled to the housing, the dial assembly having a plurality of dispensing ports alternately aligned with the outlet of the housing upon rotation of the dial assembly, each of the dispensing ports having a different liquid dispensing pattern;

wherein selective operation of the universal actuator substantially concurrently activates the valve assembly and the pump assembly to permit water flow through the pipe assembly and dispense the cleaning product into the water flow; and wherein selective pivoted movement of the lever in one direction substantially concurrently pulls the valve stem to open water flow between the faucet and said pipe assembly and pushes the piston and the cross member to pump and dispense the cleaning product into the water flow.

* * * * *